US009610487B2

(12) United States Patent
Ahn

(10) Patent No.: US 9,610,487 B2
(45) Date of Patent: Apr. 4, 2017

(54) SWING SPORT INSTRUMENT TRAINING DEVICE AND METHOD OF USING SAME

(71) Applicant: Andrew Young Ahn, Sparkill, NY (US)

(72) Inventor: Andrew Young Ahn, Sparkill, NY (US)

( * ) Notice: Subject to any disclaimer, the term of this patent is extended or adjusted under 35 U.S.C. 154(b) by 118 days.

(21) Appl. No.: 14/805,413

(22) Filed: Jul. 21, 2015

(65) Prior Publication Data

US 2015/0335975 A1 Nov. 26, 2015

Related U.S. Application Data

(60) Provisional application No. 62/027,056, filed on Jul. 21, 2014.

(51) Int. Cl.

| | |
|---|---|
| ***A63B 69/38*** | (2006.01) |
| ***A63B 69/00*** | (2006.01) |
| ***A63B 69/36*** | (2006.01) |

(52) U.S. Cl.

CPC ..... *A63B 69/0059* (2013.01); *A63B 69/3632* (2013.01); *A63B 69/3685* (2013.01); *A63B 69/38* (2013.01); *A63B 2209/10* (2013.01); *A63B 2225/09* (2013.01)

(58) Field of Classification Search

CPC . A63B 69/38; A63B 69/0059; A63B 69/3632; A63B 69/3685; A63B 69/36; A63B 2209/10; A63B 2225/09

See application file for complete search history.

(56) References Cited

U.S. PATENT DOCUMENTS

| | | | | | |
|---|---|---|---|---|---|
| 2,022,910 | A * | 12/1935 | Hanley | A63B 69/0059 | 2/159 |
| 2,103,502 | A * | 12/1937 | Webster | A63B 69/3608 | 473/215 |
| 3,740,052 | A * | 6/1973 | Arkin | A63B 21/0552 | 473/214 |
| 3,858,881 | A * | 1/1975 | Hurwitz | A63B 69/38 | 473/229 |
| 3,937,465 | A * | 2/1976 | Roland | A63B 69/38 | 473/229 |
| 4,030,732 | A * | 6/1977 | Vincent | A63B 21/0004 | 473/229 |
| 4,150,821 | A * | 4/1979 | Racz | A63B 69/38 | 473/464 |
| 4,209,169 | A * | 6/1980 | Roberts | A63B 69/38 | 473/464 |
| 4,265,448 | A * | 5/1981 | Anderson, Jr. | A63B 49/08 | 473/553 |

(Continued)

*Primary Examiner* — Raleigh W Chiu

(57) ABSTRACT

The swing training aid includes an arm band and an adjustable cord attached to the racket and the arm band through an adjustable hook. The arm band is adjustably and detachably secured around an arm of a player. A hook strap is attached on the outside of the arm band and defines an opening for receiving the hook. The elastic cord has one end having a loop whose diameter is sufficiently large to receive a handle of the sport swing instrument. The adjustable hook has a base and a hook portion extending from the base and terminating at a hook end. The hook portion is designed to be coupled to the hook strap and the base of the adjustable hook is designed to receive the end of the elastic cord and adjustably lock the cord once the cord length has been adjusted for the player.

16 Claims, 7 Drawing Sheets

(56) References Cited

U.S. PATENT DOCUMENTS

| | | | | | |
|---|---|---|---|---|---|
| 4,432,121 | A | | 2/1984 | Dupre | |
| 4,445,686 | A | * | 5/1984 | Daugherty | A63B 69/38 473/464 |
| 4,622,724 | A | | 11/1986 | Dupre | |
| 5,174,575 | A | * | 12/1992 | Leith | A63B 69/0059 473/213 |
| 5,476,257 | A | * | 12/1995 | Bobby | A63B 69/0059 473/464 |
| 5,618,040 | A | * | 4/1997 | Parten | A63B 21/0004 473/461 |
| 6,827,654 | B2 | * | 12/2004 | Meyer | A63B 69/0059 24/300 |
| 6,938,306 | B2 | | 9/2005 | Joubert | |
| 7,128,658 | B2 | * | 10/2006 | DuFour | A63B 69/0059 473/207 |
| 7,147,581 | B1 | | 12/2006 | Williams | |
| 7,156,748 | B2 | * | 1/2007 | Burke | A63B 69/0059 473/207 |
| 7,322,894 | B2 | | 1/2008 | Darmohusodo | |
| 7,354,361 | B2 | | 4/2008 | Williams | |
| 7,445,570 | B2 | | 11/2008 | Rodgers | |
| 7,559,859 | B2 | | 7/2009 | Rodgers | |
| 2007/0123372 | A1 | * | 5/2007 | Bilsey | A63B 69/38 473/464 |
| 2007/0275796 | A1 | * | 11/2007 | Carter | A63B 69/38 473/459 |
| 2008/0220911 | A1 | * | 9/2008 | Rodgers | A63B 69/38 473/461 |
| 2009/0011869 | A1 | * | 1/2009 | Bozof | A63B 69/38 473/424 |
| 2012/0137475 | A1 | | 6/2012 | Seader | |
| 2015/0335975 | A1 | * | 11/2015 | Ahn | A63B 69/0059 473/461 |

* cited by examiner

SWING SPORT INSTRUMENT TRAINING DEVICE AND METHOD OF USING SAME

CROSS-REFERENCE TO RELATED APPLICATION

The present application claims priority to U.S. provisional application Ser. No. 62/027,056, filed Jul. 21, 2014 and entitled "RACKET SPORT TRAINING DEVICE", which is incorporated herein in its entirety.

FIELD OF THE INVENTION

The present invention is directed to a training device for a swing sport instrument, and in particular, tennis swing training aid.

BACKGROUND OF THE INVENTION

In a racket game such as tennis, there are several flaws that are common among the players. One major flaw occurs during a swing such as a forehand, backhand, volley and serve.

For a forehand stroke, the wrist should be cocked or laid-back (extended) in a position called a hitting structure. For the most efficient swing and consistency, the hitting structure should be maintained from the forward swing throughout the contact position. However, beginner players make two common mistakes. One is that they keep the racket in a nearly straight line with the arm in an improper hitting structure. While they think they are hitting the ball harder by "arming" the ball, such a swing actually causes a substantial loss in power, not to mention the possibility of inducing tennis elbow due to the excessive stress placed on the extensor tendon connected to the humerus bone. Even if the beginner players do have the correct hitting structure, they incorrectly snap their wrist forward near the point of impact. In technical terms, the wrist goes to flexion, which causes inconsistency in the ball direction. A similar problem exists for a backhand.

In a volley stroke, the recommended hitting structure is to maintain a sharp angle between the racket and the arm (sometimes called an "L") from the forward swing to impact whenever possible. However, the beginner players "break" their wrist during the forward swing, which causes the racket to move away from the "L" to more of an "I" shape, i.e., the racket being in line with the arm. Such wrist movement causes a loss of consistency.

In serves, professional players hold their racket such that it forms an angle of 15-50 degrees at the point of impact with a tennis ball to provide maximum racket speed from pronating the hand. Pronation means a combination of a forearm roll and internal shoulder rotation. By contrast, average players hold their racket too vertically and the racket-forearm angle is close to 0 at the point of impact. This reduces the racket head speed greatly, not to mention the likely injury to their shoulder.

A number of different training aids have been presented in the prior art to attempt to correct some of these problems. However, there are a number of deficiencies with these devices. Many are difficult and uncomfortable to wear. Others are unnecessarily complicated to adjust for different strokes.

Therefore, it would be desirable to provide a racket swing training device that is simple to use and adjust for working on different swing strokes.

SUMMARY OF THE INVENTION

According to an aspect of the present invention, a sport swing instrument training device includes an arm band, hook receiver, adjustable hook and elastic cord to provide a novel way to practice perfect swings.

The arm band is adjustably and detachably secured around an arm of a player. The hook receiver is attached on the outside of the arm band and defines an opening for receiving a hook. The elastic cord has a first end and a second end having a loop whose diameter is sufficiently large to receive a handle of the sport swing instrument. The adjustable hook has a base and a hook portion extending from the base and terminating at a hook end. The hook portion is designed to be coupled to the hook receiver and the base of the adjustable hook is designed to receive the first end of the elastic cord and adjustably lock the cord once the cord length has been adjusted for the player.

DETAILED DESCRIPTION OF THE INVENTION

Figure 1A:
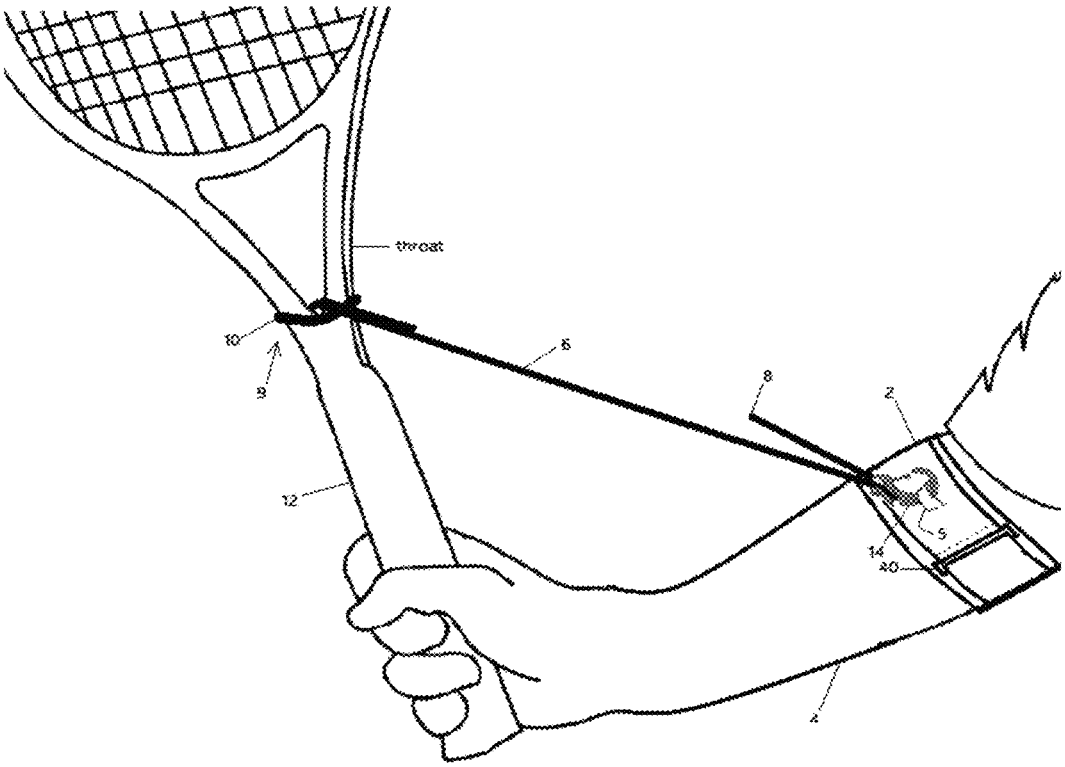
FIGS. 1A-1B illustrate the racket swing training device in use according an aspect of the present invention.

FIG. 1A illustrates the racket swing training device 1 in use according to an aspect of the present invention. The racket swing training device 1 includes an arm band 2, an elastic cord 6 and an adjustable hook 14.

The arm band 2 is worn around an arm 4 of a user. The arm band 2 is adjustably and detachably secured around an arm 4 of a racket sport player. The band 2 has a width of about 2⅝" for an elastic inner band 34 and 2" for an inelastic outer band 38 as will be discussed in detail later herein. Typically it will be worn around the upper part of the forearm near the elbow. It can also be worn around the lower part of the upper arm near the elbow, whichever way is comfortable for the player.

Figure 2:
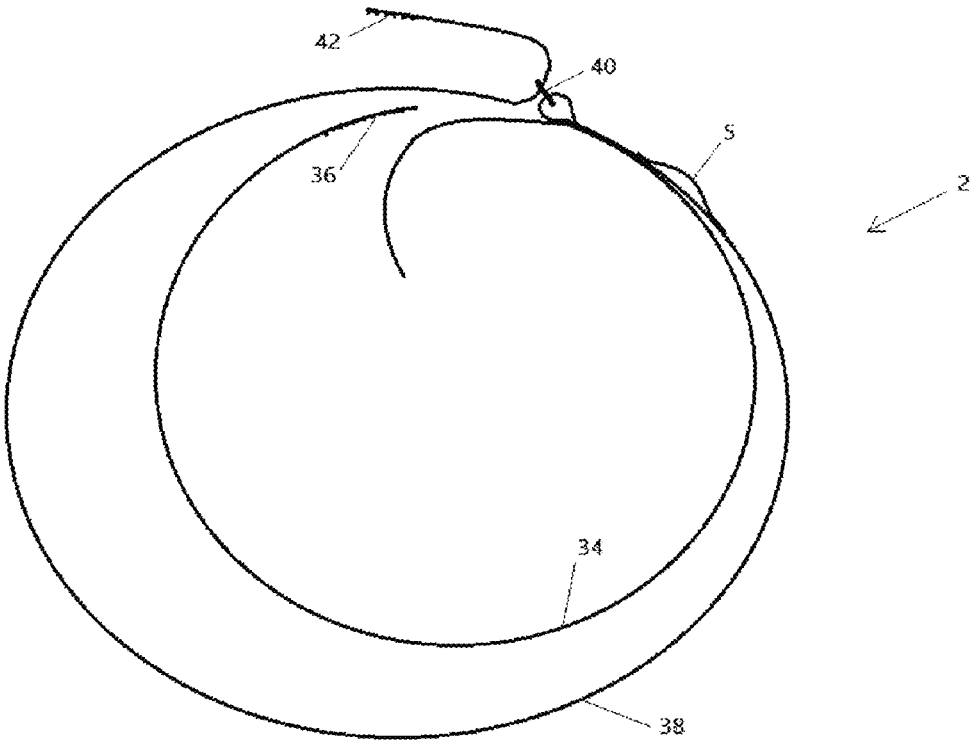
FIG. 2 illustrates a side view of an arm band according to one aspect of the present invention.

An elastic cord 6 has a first end 8 and a second end 9 that form a loop 10 which has a sufficiently large diameter to receive the butt end of a racket handle 12 (preferably in its un-stretched length). The loop 10 is inserted through the butt cap of a racket and the first end 8 is then inserted through the open throat of the racket. The first end 8 is threaded through an adjustable hook 14 to provide the right amount of wrist lay back (wrist extension) and tension which is comfortable for the player. The hook 14 is then hooked onto a hook strap (receiver) 5 which is shown in FIG. 2 and is sewn into the outer surface of the inelastic outer band 38 of the arm band 2. The space between the hook strap 5 and the outer surface of the band 2 defines an opening through which the hook 14 is inserted.

In a preferred embodiment, the elastic cord 6 has a 50% stretch (in length) with 5 pounds or less of force, inclusive. More preferably, the elastic cord 6 has a 50% stretch (in length) with 2 to 4 pounds of force, inclusive, to provide sufficient resistance force for the player to feel the force and yet make the cord comfortable to allow some flexion of the wrist during the swing or after the ball has been hit in a follow through. Preferably the elastic cord 6 has a diameter of 3/16"-3/8" (5 mm-9 mm), inclusive. The cord 6 shown in the figures is a 6 mm elastic cord measured at 50% stretch with 2.8 pounds of force. The extent of elasticity of the cord 6 is important because too little elasticity makes the device uncomfortable for the user and too much elasticity does not provide sufficient tactile feedback for the device to be effective. Also important is that some elasticity needs to be provided to allow the player to naturally release the wrist after the ball is struck.

Typically, the cord length is adjusted so that the wrist is laid back (extended) by 90 degrees without any tension on the cord 6. When starting out, however, it is recommended that the cord 6 is at some tension (e.g., around 10 to 20 pounds of force) with the wrist laid back 90 degrees to make sure the player feels the wrist bend at 90 degrees when the ball is struck. When the player becomes accustomed to laying the wrist back, cord length/tension can be relaxed a bit so as to allow some amount of wrist flexion at impact and follow through for more power and comfort.

Figure 1B:
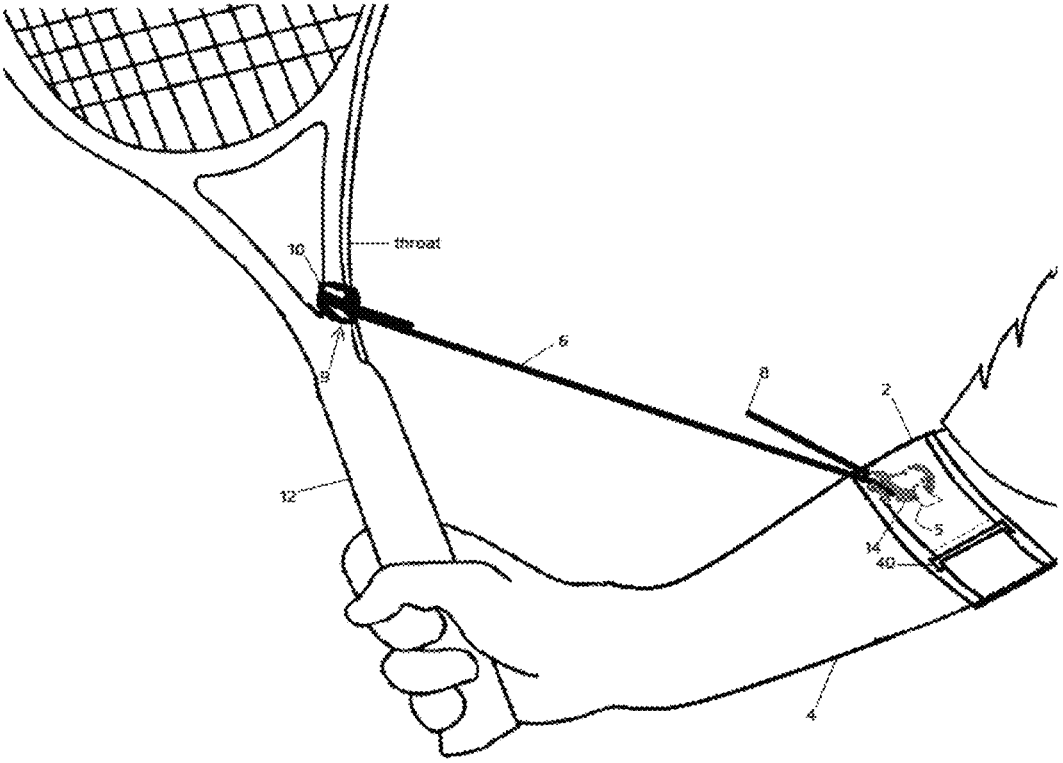

FIG. 1B shows an alternate way to attach the loop 6 to the racket. The loop 6 is wrapped around one side frame of the open throat and the first end is inserted through the loop and pulled to form a tight noose. The cord length can be adjusted with the first end 8 depending on the types of strokes the player wants to practice. This type of a setup may be particularly useful for volley practice.

For volleys, laying back the racket by 90 degrees may be a good idea. For serves, adjusting the cord to have a 20-45 degree angle between the racket and the forearm may be ideal. For any of the strokes, however, the attaching method of either FIG. 1A or FIG. 1B is acceptable.

FIG. 2 illustrates a side view of the arm band 2. The band 2 includes an inner band 34 made of very elastic Neoprene fabric and an inelastic outer band 38. The inner band 34 has an inner surface and an outer surface and the distal portion of the inner surface of the inner band has hundreds of tiny fasteners 36 (e.g., flexible resilient open hooks such as Velcro elements) that grab tiny loops of flexible resilient fabric material disposed on the outer surface of the inner band to fasten the inner band.

One end of the outer band 38 is threaded into a slit 40 and is sewn into the inner band 34 to fix the slit and the outer band to the inner band. The outer surface of a distal portion at the other end of the outer band 38 also has hundreds of tiny fasteners 42 (e.g., flexible resilient open hooks such as Velcro elements) that grab tiny loops of flexible resilient fabric material disposed on the outer surface of the outer band to fastens the outer band.

To wear the band 2, the length of the inner band 34 is adjusted and the inner band 34 is fastened by pushing the fastener 36 onto the complementary fasteners (e.g., tiny fabric loops) on the outer surface of the inner band. Once, the inner band 34 is fastened to the arm 4, the distal end having the fastener 42 is threaded through the slit 40 and looped back. After adjusting the tension of the band 2 against the arm 4, the fastener 42 is pressed onto the complementary fasteners (e.g., tiny fabric loops) on its outer surface.

The hook strap (receiver) 5 is a short fabric of high strength web material and is sewn onto the outer surface of the outer band 38 on both ends. In one embodiment, the width of the hook strap is 0.5 inches and the length between the two sewing marks is about 1.5 inches. The opening defined by the hook strap 5 and the outer band 38 is adapted to receive the hook 14.

Figure 3A:
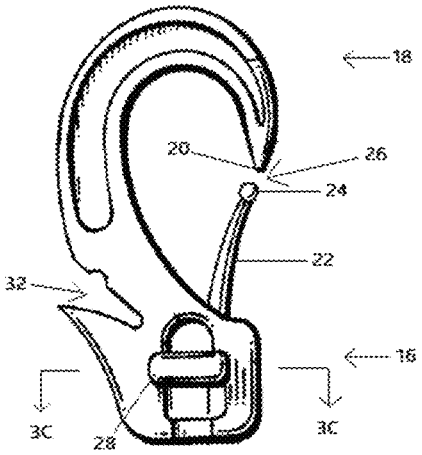
FIGS. 3A-3C illustrate an adjustable hook in various perspective views according to one aspect of the present invention.
Figure 3B:
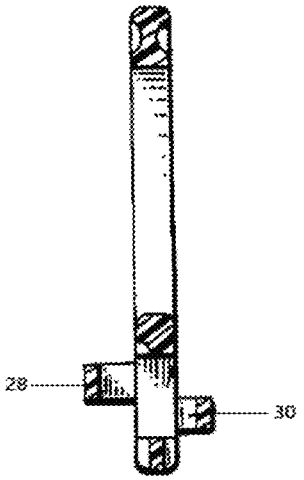
Figure 3C:
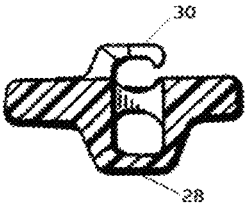

FIGS. 3A-3C illustrate a preferred embodiment of an adjustable hook 14 according to an aspect of the present invention. FIG. 3C is a cross-sectional view along the line 3C-3C of FIG. 3A. The hook 14 has a base 16 and a hook portion 18 extending from the base and terminating at a hook end 20. The base 16 has a stationary flexible tongue (gate) 22. The tongue 22 extends from the base and has a free end 24 which is spaced from the hook end 20 to define a hook entrance 26 through which the hook strap 5 enters. The base 16 includes an entrance opening/guide 28, an exit opening/guide 30 and a tapered cord locking slot 32. The first end of the cord enters the entrance guide 28 and exits through the exit guide 30 while the tapered cord locking slot 32 positioned between the two guides engages the cord 6 to adjustably lock the cord in use.

In the embodiment shown, the entrance guide 28 is circumferentially closed while the exit guide is circumferentially partially laterally open. To adjust the cord length, the cord 6 is laterally removed from the exit guide 30 through the lateral opening and then is pulled away from the tapered cord locking slot 32 to unlock the cord from the hook 14. The cord length is then adjusted relative to the entrance guide 28 by sliding the cord 6 along the entrance guide 28. Once the cord 6 has been adjusted to the proper length for a selected stroke type to practice and for the particular player, the cord is then pushed into the tapered cord locking slot 32 to lock the cord and then is inserted into the exit guide 30 laterally through the partial opening. This way, adjustment of the cord 6 becomes very easy with no need to undo any knot or remove the cord completely from the hook or remove the hook from the band 2. As can be appreciated by persons of ordinary skill in the art, the locking slot 32 is advantageously disposed on the opposite side to the hook opening 26 such that adjusting of the cord length can take place more easily without removing the hook from the hook strap 5.

As a result, cord length adjustment for different swing strokes for a particular player can be very conveniently made with only one hand without removing the hook from the band 2 or the racket from the cord 6. Moreover, since the cord 6 can be detached very easily from both the racket and the band 2, it can be removed and the band which is a type of a tennis elbow compression band can be worn on its own simply by removing the hook from the hook receiver 5 and the loop 10 from the racket.

Figure 4:
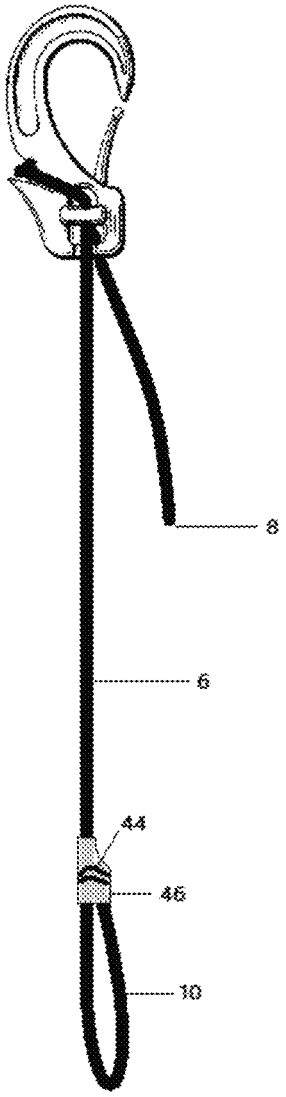
FIG. 4 illustrates an elastic cord attached to the adjustable hook according to one aspect of the present invention.

FIG. 4 illustrate the elastic cord 6 coupled to the adjustable hook 14. The loop 10 can be formed by any fastener 44 including a knot, ring, crimp ring, hog ring, plastic tie, clamp, clip, band (e.g., rubber band), staples, push type fastener, cord snap fastener and the like. In the embodiment shown in FIG. 4, the cord 6 has a clamped hog ring 44 to define the loop 10 and a heat shrunk tube 46 surrounding the clamped ring. To make the loop 10, the hog ring 44 is clamped on the cord 6 and a heat shrink tubing 46 is slid over the ring, and then shrank around the ring with a heat gun such as a blow dryer. The heat shrink tubing 46 covers the hog ring 44 to prevent the metallic ring or any sharp ends of the ring from scraping against the racket and the arm.

Preferably, the inner diameter of the loop 10 is between 5 inches and 11 inches, inclusive, in its un-stretched form. Such diameter allows the loop 6 to be received by a butt cap of the diameter of the highest grip size for the handle 12. More preferably, the loop 10 diameter is between 7 inches and 11 inches. This length is important also because when the first end 8 is inserted through the open throat of the racket, the heat shrunk tube 46 preferably should not be laying over any portion of the loop or over the bottom part of the open throat of the racket. If it does, there is a possibility that the crimped hog ring may rub against the loop 10 or against the frame of the racket. Even if the crimped hog ring is protected by the heat shrunk tube 46, the tube may rub against the frame and come off the loop.

Preferably, the inner diameter of the loop 10 is between 5 inches and 11 inches, inclusive. Such diameter allows the loop to be received by a butt cap of the highest diameter handle of the racket. More preferably, the loop is between 7 inches and 11 inches. This length is important because when the first end is inserted through the open throat of the racket, the heat shrunk tube 46 preferably should not be laying over any portion of the loop or over the bottom part of the open throat of the racket. If it does, there is a possibility that the crimped hog ring 44 may rub against the loop 10 or against the frame of the racket. Even if the crimped hog ring 44 is protected by the heat shrunk tube 46, the tube may rub against the frame and come off the loop.

Figure 5A:
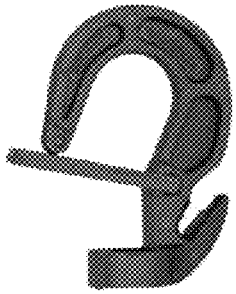
FIGS. 5A and 5B illustrate different adjustable hooks that can be used according to other aspects of the present invention.
Figure 5B:
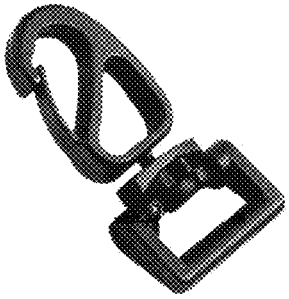

FIGS. 5A and 5B are some of the alternate embodiments of a hook that can be used with the present invention. In FIG. 5A, the hook has a latch having one end rotatably attached to a lower part of the hook portion and the other end with an opening which is adapted to be locked by a pair of oppositely disposed bumps at the hook end. In FIG. 5B, the hook base includes a fixed portion fixedly attached to the hook portion and includes a stationary flexible tongue which is biased to close, and a rotatable portion rotatably coupled to the fixed portion and including a slit for receiving the elastic cord/band.

Figure 6:
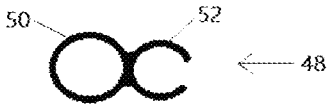
FIG. 6 illustrates a cord holder according to one aspect of the present invention.

FIG. 6 is a cord holder 48 which is designed to hold the first end 8 close to the cord 6 coupled between the hook 14 and the racket. The cord holder 48 has a first guide 50 with a closed opening. The inner diameter of the first guide 50 is larger than the diameter of the cord 6 such that the cord freely slides therein. The second guide 52 is made of a flexible but resilient material and the opening of the second guide 52 has a partial opening. The diameter of the second guide opening 52 is smaller than the diameter of the cord 6 such that when the cord is pushed into the second guide through the partial opening, the cord is held tightly and securely. When the present invention is in use, the cord 6 will stretch at times as the player swings the racket. When that occurs, the cord 6 will freely slide in the first guide while the second guide 52 holds the free end 8 near the cord 6 to prevent the free end 8 from swinging, which could distract the player.

Figure 7:
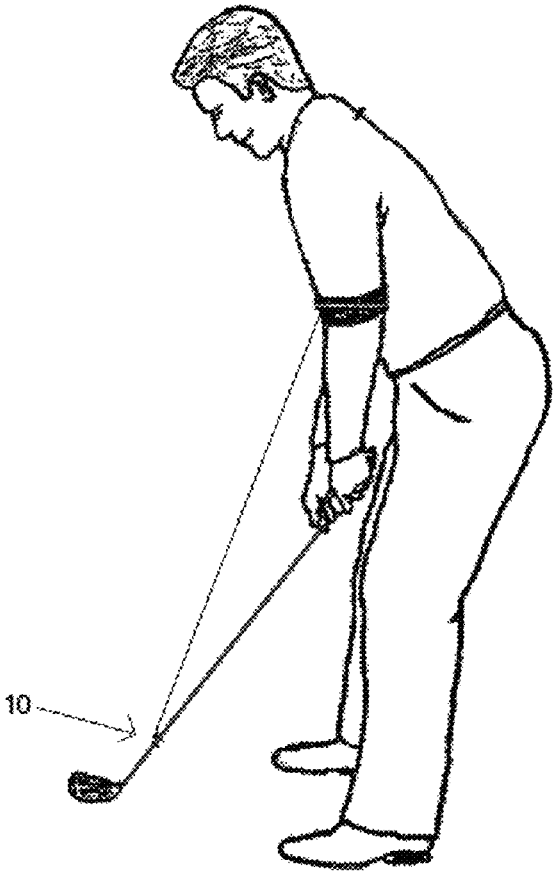
FIG. 7 illustrates use of the present invention as a golf club swing training aid.

FIG. 7 is another use of the present invention in the context of golf. The band 2 and the adjustable hook 14 can be worn in a similar manner as above (see FIG. 1A, for example) while the loop 10 is securely fastened to a golf club in a similar manner to FIG. 1B, in that the loop 10 is wrapped around the golf club at a predetermined location from the club head and then the first end 8 is threaded into the opening of the loop. The first end 8 is then pulled to tightly secure the cord 6 to the club. At the predetermined location of the club shaft, a band (adhesive strip) having an adhesive on its inner surface and a rough surface on its exterior surface for increased friction may be applied. The present invention is designed to develop and maintain the most accurate positioning of the hand and wrist. Correct positioning of the hands and wrists with using the device of the invention aids in driving the golf ball farther and straighter, allows chipping and putting the ball better, improves accuracy, and most importantly helps develop and maintain muscle memory so that the golfer who has practiced with the device can improve later performance even when the device is not being used. Routine practice with the device of the invention can thus improve confidence, which also improves performance.

As can be appreciated by persons of ordinary skill in the art, the present invention promotes proper technique which reduces the chance of injury to the player's elbow or shoulder. In fact, if the player has a tennis elbow, using the present invention may reduce further injury as it provides support for the weakened tendon and the arm band tends to shift the shock impact to the forearm muscles.

The above disclosure is intended to be illustrative and not exhaustive. This description will suggest many modifications, variations, and alternatives may be made by ordinary skill in this art without departing from the scope of the invention. Those familiar with the art may recognize other equivalents to the specific embodiments described herein. Accordingly, the scope of the invention is not limited to the foregoing specification.

What is claimed is:

1. A sport swing instrument training device comprising:

an arm band adapted to be adjustably and detachably secured around an arm of a player;

a hook receiver attached on the outside of the arm band and defining an opening for receiving a hook;

an elastic cord having a first end and a second end having a loop whose diameter is sufficiently large to receive a handle of the sport swing instrument;

an adjustable hook having a base and a hook portion extending from the base and terminating at a hook end, the hook portion adapted to be coupled to the hook receiver, the base of the adjustable hook adapted to receive the first end of the elastic cord and adjustably lock the cord;

wherein the arm band has an elastic inner band having an inner surface and an outer surface and the distal portion of the inner surface of the inner band is adapted to be fastened to the outer surface of the inner band.

2. The sport swing instrument training device of claim 1, wherein the elastic cord has a 50% stretch with 5 pounds or less of force.

3. The sport swing instrument training device of claim 1, wherein the elastic cord has a 50% stretch with 2 to 4 pounds of force.

4. The sport swing instrument training device of claim 1, wherein the inner diameter of the loop in unstretched form is between 5 inches and 11 inches, inclusive.

5. The sport swing instrument training device of claim 1, wherein the elastic cord has a clamped ring to define the loop and a heat shrunk tube surrounding the clamped ring.

6. The sport swing instrument training device of claim 1, wherein the arm band has a non-elastic outer band extending from the inner band.

7. The sport swing instrument training device of claim 6, wherein the hook receiver includes a hook strap positioned on the outer surface of the outer band to define hook receiving opening therebetween.

8. The sport swing instrument training device of claim 7, wherein the arm band includes a slit attached to the outer surface of the outer band through which a distal end of the outer band is inserted and looped back, and the distal portion of the outer surface of the outer band is adapted to be fastened to the outer surface of the outer band.

9. The sport swing instrument training device of claim 8, wherein the hook strap is attached to the outer surface of the outer band and positioned distally from the slit.

10. The racket swing training device of claim 1, wherein:

the base has a stationary flexible tongue whose free end is spaced from the hook end to define a hook entrance through which the hook receiver enters, the base includes an entrance opening, an exit opening and a tapered cord locking slot positioned therebetween, wherein the first end of the cord is adapted to enter the entrance opening and exit through the exit opening while the tapered cord locking slot engages the cord to adjustably lock the cord.

11. The racket swing training device of claim 10, wherein the entrance opening is a closed opening and the exit opening is a partially open exit opening.

12. The racket swing training device swing training device of claim 1 wherein the base includes:

a fixed portion fixedly attached to the hook portion; and a rotatable portion rotatably coupled to the fixed portion and adapted to adjustably lock the cord.

13. A racket swing training device comprising:

an arm band adapted to be adjustably and detachably secured around an arm of a racket sport player, wherein the arm band has an elastic inner band having an inner surface and an outer surface and the distal portion of the inner surface of the inner band is adapted to be fastened to the outer surface of the inner band;

a hook strap attached on the outside of the arm band and defining an opening therebetween for receiving a hook;

an elastic cord having a first end and a second end having a loop sufficiently large to receive a racket handle, the loop adapted to be securely attached to a throat of the racket;

an adjustable hook having a base and a hook portion extending from the base and terminating at a hook end, the base having a flexible tongue whose free end is spaced from the hook end to define a hook entrance through which the hook strap enters, the base including an entrance opening, an exit opening and a tapered cord locking slot, wherein the first end of the cord is adapted to enter the entrance opening and exit through the exit opening while the tapered cord locking slot engages the cord to adjustably lock the cord in use.

14. The sport swing instrument training device of claim 13, wherein the elastic cord has a 50% stretch with 5 pounds or less of force.

15. A method of using a racket swing training device comprising:

adjustably and detachably securing an arm band around an arm of a racket sport player, wherein the arm band has an elastic inner band having an inner surface and an outer surface and securing the arm band around the arm includes fastening the distal portion of the inner surface of the inner band to the outer surface of the inner band;

slidably inserting a loop defining a second end of an elastic cord over a handle of the racket;

inserting the elastic cord through an open throat of the racket;

pulling on a first end of the elastic cord to securely fasten the loop to the throat of the racket;

inserting a hook portion of an adjustable hook through an opening defined by a hook strap attached on the outside of the arm band, the adjustable hook securely and adjustably locking the elastic cord to place a wrist of the player in an extended position.

16. The method of claim 15, wherein the adjustable hook has a base including an entrance opening, an exit opening and a tapered cord locking slot, the method further comprising inserting the first end of the elastic cord through the entrance opening and then through an exit opening such that the tapered cord locking slot adjustably locks the cord.

* * * * *